US010107046B2

(12) United States Patent
Royer et al.

(10) Patent No.: US 10,107,046 B2
(45) Date of Patent: Oct. 23, 2018

(54) ARTICULATING GRASSHOPPER ARM

(71) Applicant: Nabors Drilling USA, Houston, TX (US)

(72) Inventors: Ted Royer, Houston, TX (US); Todd Fox, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 675 days.

(21) Appl. No.: 14/176,578

(22) Filed: Feb. 10, 2014

(65) Prior Publication Data

US 2014/0224944 A1 Aug. 14, 2014

Related U.S. Application Data

(60) Provisional application No. 61/763,070, filed on Feb. 11, 2013.

(51) Int. Cl.
*E04G 3/00* (2006.01)
*E21B 15/00* (2006.01)

(52) U.S. Cl.
CPC ..... *E21B 15/00* (2013.01); *E21B 15/003* (2013.01)

(58) Field of Classification Search
CPC ..... E21B 15/00
See application file for complete search history.

(56) References Cited

U.S. PATENT DOCUMENTS 1,236,960 A * 8/1917 McMillan ..... E04H 12/24 248/125.1
1,874,189 A * 8/1932 Howard ..... B66C 13/18 212/245
2,947,425 A * 8/1960 Nichols ..... B66C 23/36 212/238
3,019,918 A * 2/1962 Keener ..... B66C 23/36 212/237
3,543,989 A * 12/1970 Cooper ..... B23K 9/287 182/141
3,911,849 A * 10/1975 Hammelmann ..... B05B 13/005 114/222
4,098,371 A * 7/1978 Cox ..... B66F 11/044 182/2.7
4,217,971 A * 8/1980 Rivinius ..... B60R 3/02 182/2.7
4,556,358 A * 12/1985 Harlan ..... B60P 1/5433 212/238
4,710,090 A * 12/1987 DeLuca ..... B66C 23/44 212/238
5,232,192 A * 8/1993 Akutagawa ..... B23K 37/0211 248/283.1
5,571,256 A * 11/1996 Good ..... H02B 1/36 211/151

(Continued)

FOREIGN PATENT DOCUMENTS

DE 2540572 A1 * 3/1977 ..... E21B 7/022
EP 0644150 A1 * 3/1995 ..... B23K 37/0211

*Primary Examiner* — Amy J. Sterling
(74) *Attorney, Agent, or Firm* — Adolph Locklar

(57) ABSTRACT

An articulating grasshopper arm includes a cable tray. The cable tray is pivotably coupled to a drilling rig by at least one pivot point. The pivot point is adapted to allow the cable tray to pivot upward and downward as well as laterally right and left relative to the drilling rig.

9 Claims, 1 Drawing Sheet

(56) References Cited

U.S. PATENT DOCUMENTS

| | | | | |
|---|---|---|---|---|
| 5,725,112 | A * | 3/1998 | Thorby | B66C 23/44 212/180 |
| 5,755,296 | A | 5/1998 | Richardson et al. | |
| 6,425,727 | B1 * | 7/2002 | Hood | B66C 23/44 212/180 |
| 6,913,097 | B1 | 7/2005 | Orr et al. | |
| 6,983,856 | B1 * | 1/2006 | Burks | B66C 23/20 212/179 |
| 7,096,963 | B2 * | 8/2006 | Moncus | E21B 19/00 166/381 |
| 7,234,896 | B2 | 6/2007 | Donnally et al. | |
| 7,360,589 | B2 * | 4/2008 | Moncus | E21B 19/06 166/379 |
| 7,845,622 | B1 * | 12/2010 | Riggs | B66C 23/44 212/180 |
| 8,701,897 | B2 | 4/2014 | Bailey et al. | |
| 8,820,499 | B2 | 9/2014 | Wells, Sr. | |
| 9,151,412 | B2 | 10/2015 | Trevithick et al. | |

* cited by examiner

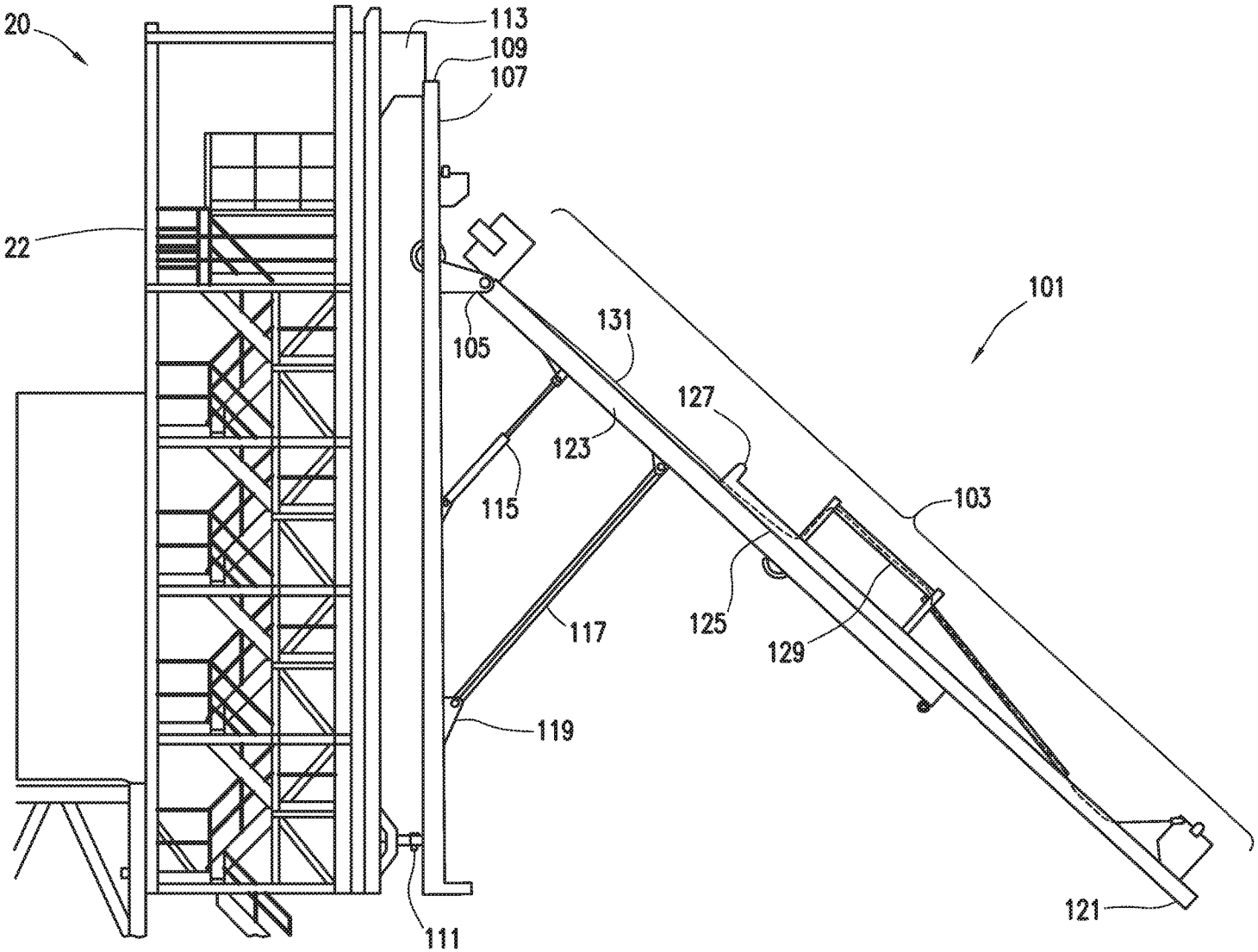
101
103
105
107
109
113
115
117
119
121
123
125
127
129
131
111
20
22

ARTICULATING GRASSHOPPER ARM

CROSS-REFERENCE TO RELATED APPLICATIONS

This application is a non-provisional application which claims priority from U.S. provisional application No. 61/763,070, filed Feb. 11, 2013.

FIELD OF DISCLOSURE

The present disclosure is related in general to cable handling, and specifically to a drilling rig cable tray apparatus.

BACKGROUND OF THE DISCLOSURE

Traditionally on land-based drilling rigs, electrical power generation and hydraulic equipment is located adjacent to or nearby the rig, rather than on the rig itself. A cable-tray, often known in the industry as a "grasshopper", includes electrical cables and hydraulic lines designed to transport electrical power and hydraulic fluid to the drilling rig floor from equipment adjacent or near the rig. The traditional grasshopper is fixed in that the grasshopper must be disassembled and reinstalled each time the drilling rig is moved.

SUMMARY

An articulating grasshopper arm is disclosed. The articulating grasshopper arm includes a cable tray. The cable tray is pivotably coupled to a drilling rig by at least one pivot point. The pivot point is adapted to allow the cable tray to pivot upward and downward as well as laterally right and left relative to the drilling rig.

DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 1 is a depiction of an articulating grasshopper arm consistent with at least one embodiment of the present disclosure.

DETAILED DESCRIPTION

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts articulating grasshopper arm 101 consistent with embodiments of the present disclosure. In some embodiments, articulating grasshopper arm 101 may include cable tray 103. Cable tray 103 may be pivotably attached to drilling rig 20 by upper pivot point 105. In some embodiments, upper pivot point 105 may allow cable tray 103 to pivot in two dimensions, allowing cable tray 103 to pivot up and down, or laterally left and right. In some embodiments, upper pivot point 105 may allow cable tray 103 to move in three dimensions, allowing cable tray 103 to pivot up and down, as well as laterally left and right. In some embodiments, upper pivot point 105 may be coupled directly to mast 22 of drilling rig 20.

In some embodiments, such as depicted in FIG. 1, upper pivot point 105 may be coupled to secondary frame 107, which is then coupled to mast 22 of drilling rig 20. In some such embodiments, secondary frame 107 may be pivotably coupled to mast 22 at upper and lower frame pivot points 109, 111. In some such embodiments, upper and lower frame pivot points 109, 111 may allow secondary frame 107 (as well as cable tray 103) to pivot in two dimensions, laterally left and right, while upper pivot point 105 may allow cable tray 103 to pivot in two dimensions, up and down, thus allowing cable tray 103 to pivot in three dimensions relative to drilling rig 20. In some embodiments, as depicted in FIG. 1, secondary frame may be coupled to shipping frame 113 by frame pivot points 109, 111. Shipping frame 113 may then be coupled to mast 22 of drilling rig 20. One having ordinary skill in the art with the benefit of this disclosure will understand that upper pivot point 105, upper and lower frame pivot points 109, 111 may take any form suitable for allowing the coupled components to pivot relative to each other. Such pivots may include, without limitation, pin joints, ball and socket joints, etc. Additionally, the positions of upper and lower frame pivot points 109, 111 as depicted are merely illustrative, and may be reconfigured within the scope of this disclosure. For example, any number of pivot points may be utilized, and they may be located at any point on articulating grasshopper arm 101. As one of ordinary skill in the art with the benefit of this disclosure will recognize, the maximum angle at which upper and lower frame pivot points 109, 111 may pivot may be pre-determined. In non-limiting embodiments, upper and lower frame pivot points 109, 111 may allow pivoting of secondary frame 107 relative to the longitudinal axis of shipping frame 113 by as much as 90° or by as much as 60° or by as much as 40°.

Likewise, upper pivot point 105 may allow pivoting of cable tray 103 by as much as 120°, by as much as 90° or by as much as 60° or by as much as 40°. Any suitable actuator may be used to pivot cable tray 103 about upper pivot point 105. For instance, a winch or drawworks may be used to raise and lower cable tray 103. In other embodiments, such as depicted in FIG. 1, one or more hydraulic cylinders 115 may be positioned to provide the motive force to pivot cable tray 103 upward or downward. As the arm of hydraulic cylinder 115 is extended, cable tray 103 may be pivoted upward about upper pivot point 105. Likewise, as the arm of hydraulic cylinder 115 is retracted, cable tray 103 may pivot downward about upper pivot point 105. In certain embodiments of the present disclosure, such as that shown in FIG. 1, brace 117 may be provided for support of cable tray 103 as cable tray 103 is pivoted about upper pivot point 105. Brace 117 may extend between cable tray 103 and secondary frame 107. As cable tray 103 is pivoted about upper pivot point 105 upwardly, frame brace bearing 119 may, for example, slide upwardly along secondary frame 107. When cable tray 103 is in a desired position, frame brace bearing 119 may be pinned or bolted into place with respect to cable tray 103 and secondary frame 107. Brace 117 may then provide additional support to maintain cable tray 103 in the desired position.

Pivoting of cable tray 103 about upper pivot point 105 as well as upper and lower frame pivot points 109, 111 may allow bottom end 121 of cable tray 103 to move in three dimensions relative to drilling rig 20. In some embodiments, this articulation may allow cable tray 103 to couple between drilling rig 20 and, for example, hydraulic and electrical power generation equipment near or adjacent to drilling rig 20. In some embodiments, this articulation may allow cable tray 103 to be moved to, for example, to avoid interference between cable tray 103 and other ground fixtures or equipment such as wellhead christmas trees as drilling rig 20 is moved from one wellbore to another at a drillsite.

In some embodiments, cable tray 103 may be extendible to, for example, extend the range of articulating grasshopper arm 101 and allow drilling rig 20 to move to a point farther away from hydraulic and electrical power generation equipment. In some embodiments, cable tray 103 may include multiple cable tray segments, allowing cable tray 103 to telescopically increase in length. As depicted in FIG. 1, cable tray 103 may include two or more such segments, here depicted as upper cable tray 123 and lower cable tray 125. In some embodiments, the telescopic extension of cable tray 103 may be controlled, for example and without limitation, by winch 127. One of ordinary skill in the art with the benefit of this disclosure will recognize that other suitable methods for causing cable tray 103 to telescope may be utilized without deviating from the scope of this disclosure. Winch 127 may be used to, for example, pull lower cable tray 125 upward relative to upper cable tray 123. In some embodiments, gravity may be used to extend lower cable tray 125.

In some embodiments of the present disclosure, hydraulic lines and electrical cables 131 may be coupled directly to cable tray 103. In some embodiments, the hydraulic lines and electrical cables 131 may be housed within drag chain 129, as depicted in FIG. 1. Drag chain 129 may, for example, prevent any tangling, pinching, or kinking of the hydraulic lines and electrical cables 131 while protecting them from damage as upper and lower cable trays 123, 125 telescope inward or outward.

In some embodiments, articulating arm 101 is positioned such that when cable tray 103 is completely retracted and parallel to secondary frame 107, articulating grasshopper arm 101 may be removed from drilling rig 20, and secured in the retracted configuration. In this retracted configuration, articulating grasshopper arm 101 may be transported, for example by truck, to another drilling rig.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A system comprising:

a drilling rig, the drilling rig having a mast;

an articulating grasshopper arm, the articulating grasshopper arm comprising a cable tray, the cable tray pivotably coupled to the drilling rig by a secondary frame, the secondary frame coupled between the cable tray and the drilling rig, the secondary frame pivotably coupled to the drilling rig by at least one frame pivot point, the at least one frame pivot point adapted to allow the secondary frame to pivot laterally left and right relative to the drilling rig, the cable tray pivotably coupled to the secondary frame by at least one cable tray pivot point, the at least one cable tray pivot point adapted to allow the cable tray to pivot upward and downward relative to the secondary frame, the secondary frame adapted to allow the cable tray to pivot upward and downward as well as laterally right and left relative to the drilling rig; and a brace coupled between the cable tray and the secondary frame, the brace having a first end pivotably coupled to the cable tray and a second end that is releasably slidably connected to the secondary frame.

2. The system of claim 1, further comprising a hydraulic cylinder positioned between the secondary frame and the cable tray, the hydraulic cylinder positioned to provide motive force to the cable tray to pivot the cable tray upward or downward.

3. The system of claim 1, wherein the cable tray comprises a first and a second cable tray segment, the first and second cable tray segments being parallel and slidingly coupled so that the second cable tray segment may selectively extend beyond the end of the first cable tray segment parallel to the first cable tray segment, allowing the cable tray to extend in length.

4. The system of claim 3, wherein the first and second cable tray segments are operatively coupled to a winch, the winch positioned to move the second cable tray segment with respect to the first cable tray segment.

5. The system of claim 1, wherein the cable tray further comprises at least one cable or hydraulic line.

6. The system of claim 5, wherein the at least one cable or hydraulic line is coupled directly to the cable tray.

7. The system of claim 5, wherein the at least one cable or hydraulic line is housed within a drag chain, the drag chain coupled to the cable tray.

8. The system of claim 1, further comprising a shipping frame, the shipping frame coupled to the secondary frame by at least one frame pivot point and the mast of the drilling rig.

9. A system comprising:

a drilling rig, the drilling rig having a mast;

a secondary frame coupled to the drilling rig by at least one frame pivot point, the at least one frame pivot point adapted to allow the secondary frame to pivot laterally left and right relative to the drilling rig;

an articulating grasshopper arm comprising a cable tray pivotably coupled to the secondary frame by at least one tray pivot point, wherein the tray pivot point is adapted to allow the grasshopper arm to pivot upward and downward relative to the drilling rig, wherein the cable tray comprised a first and a second cable tray segment, the first and second cable tray segments being parallel and slidingly coupled so that the second cable tray segment can selectively extend beyond the end of the first cable tray segment parallel to the first cable tray segment;

a hydraulic cylinder positioned between the secondary frame and the cable tray and pivotably coupled to the secondary frame by at least one cylinder pivot point, the hydraulic cylinder positioned to provide motive force to the cable tray to pivot the cable tray upward or downward; and a brace coupled between the cable tray and the secondary frame, the brace having a first end pivotably coupled to the cable tray and a second end that its releasably slidably connected to the secondary frame;

whereby the articulating grasshopper arm, the hydraulic cylinder, and the brace are laterally pivotable relative to the drilling rig.

* * * * *